US007197796B2

(12) United States Patent
Bartkowiak et al.

(10) Patent No.: US 7,197,796 B2
(45) Date of Patent: Apr. 3, 2007

(54) YARN WITHDRAWAL APPARATUS

(75) Inventors: Klaus Bartkowiak, Herne (DE); Bernd Neumann, Radevormwald (DE); Manfred Stüttem, Kürten (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 70 days.

(21) Appl. No.: 11/196,080

(22) Filed: Aug. 3, 2005

(65) Prior Publication Data

US 2005/0278914 A1 Dec. 22, 2005

Related U.S. Application Data

(63) Continuation of application No. PCT/EP2004/000786, filed on Jan. 29, 2004.

(30) Foreign Application Priority Data

Feb. 5, 2003 (DE) ..... 103 04 598

(51) Int. Cl.
*D02G 1/00* (2006.01)

(52) U.S. Cl. ..... 28/248; 28/185

(58) Field of Classification Search ..... 28/248, 28/185, 186, 187, 193; 242/413, 413.1, 413.3–413.6, 242/418.1, 563; 226/11, 10; 66/125 R; 57/264, 265, 281; 139/452
See application file for complete search history.

(56) References Cited

U.S. PATENT DOCUMENTS 4,909,286 A * 3/1990 Decock et al. ..... 139/452
4,964,442 A * 10/1990 Tacq et al. ..... 139/452
4,998,567 A * 3/1991 Shaw ..... 139/116.2
5,018,390 A * 5/1991 Muller ..... 73/828
5,110,517 A * 5/1992 Lukhard et al. ..... 264/40.1
5,137,059 A * 8/1992 Baeck et al. ..... 139/452
5,295,287 A * 3/1994 Chateau ..... 28/187
5,440,870 A * 8/1995 Neumann ..... 57/265
5,544,679 A * 8/1996 Tacq ..... 139/450
5,662,148 A * 9/1997 Jacobsson et al. ..... 139/450
6,536,087 B2 * 3/2003 Stuttem ..... 28/248
2001/0037545 A1 11/2001 Stuttem

FOREIGN PATENT DOCUMENTS

EP 0 454 199 A 10/1991
FR 2 527 661 A1 12/1983
JP 2001025868 A 1/2001
WO WO 00/21866 A2 4/2000

* cited by examiner

*Primary Examiner*—Amy B. Vanatta
(74) *Attorney, Agent, or Firm*—Alston & Bird LLP

(57) ABSTRACT

A yarn withdrawal apparatus for continuously withdrawing a yarn from a feed yarn package and then from a reserve package, where the trailing yarn end on the feed package is knotted to the leading end of the yarn on the reserve package. The transition of the yarn from the feed yarn package to the reserve yarn package is detected by a sensor, which includes a movable yarn guide, which moves during the transition from an inactive position to a signaling position in a first degree of freedom of movement. To prevent the movable yarn guide from rebounding when it reaches the signaling position, the yarn guide or an element connected thereto defines a second degree of freedom of movement which is different from the first degree of freedom of movement, and such that after the rebound the movement is of such a kind that a departure from the signaling position back toward the inactive position is geometrically not possible.

15 Claims, 3 Drawing Sheets

YARN WITHDRAWAL APPARATUS

CROSS REFERENCE TO RELATED APPLICATION

The present application is a continuation of international application PCT/EP2004/000786, filed 29 Jan. 2004, and which designates the U.S. The disclosure of the referenced application is incorporated herein by reference.

BACKGROUND OF THE INVENTION

The invention relates to a yarn withdrawal apparatus, as well as a texturing machine with the yarn withdrawal apparatus of the invention. Yarn withdrawal apparatus of this type are disclosed in WO 00/21866 A2 and corresponding U.S. Patent Publ. No. 2001/0037545.

To ensure a continuous operation in a yarn treating process, wherein a yarn is unwound from a feed package and further processed, the trailing yarn end of the feed yarn package may be joined to the leading yarn end of a reserve yarn package. In this connection, the joining occurs such that after having completely unwound the yarn from the feed yarn package, the yarn continues to unwind with no trouble from the reserve yarn package.

Normally, the joining occurs by knotting or splicing. A thick place that forms in the yarn as a result thereof, represents an unavoidable decrease in quality in the subsequent process. For this reason, the above cited documents propose to detect the transition from the feed yarn package to the reserve yarn package with the use of a sensor and to respond thereto in the treatment process. The sensor is provided between the packages, and it includes a movable yarn guide, which is caused to move by the yarn change between the packages, and whose position is detected.

A problem that arises in the above process is that the rapidly advancing yarn accelerates the movable yarn guide from an inactive position to a signaling position in a very short period of time due to the very high speed of the yarn. In so doing, it is possible that in the signaling position the yarn guide rebounds on its stop, and drops back to its inactive position. While it is possible to detect and electronically store this short stay, it is not desired from the viewpoint of faster and easier operability and operational safety in the event of electrical breakdowns that the yarn guide be in its released state in the inactive position.

Obvious attempts of solving the problem, such as, for example, the use of softly absorbent stop materials, have not produced satisfactory results. This also applies to bulk material fillings, which are integrated into the yarn guide, or other additional masses that are applied for the purpose of damping its movement. The reason is to be found in that because of the small mass of the yarn guide, in combination with the high yarn speed, a slight, undamped residual energy will suffice to rebound the yarn guide into its inactive position.

Likewise, other obvious solutions, such as bi-stable layers with the aid of permanent magnets, have not brought satisfactory results. Also, air damping and electromagnetically operating dampers are unsuited to bring about the required high damping forces. In this instance, one may consider as an additional problem the fact that the speed at which the yarn guide moves to the signaling position, varies very greatly. For this reason, it is hardly possible to adjust, for example, a friction brake such that it is equally reliable in operation both at high and at low speeds of the yarn guide.

It is therefore an object of the invention to provide a sensor for detecting and signaling the transfer of the withdrawn yarn between packages, and which has a movable yarn guide which reliably prevents the yarn guide from rebounding even at varying speeds.

SUMMARY OF THE INVENTION

The above and other objects and advantages of the invention are achieved by the provision of a sensor which includes a means which prevents, because of its structure or geometry, the yarn guide from rebounding to its inactive position. The advantage of the invention lies in that irrespective of the speed at which the yarn guide is moved to its signaling position, it is prevented from rebounding, and thus operates in a reliable manner. This is accomplished in that a second degree of freedom of movement is created in addition to the movement of the yarn guide from its inactive position to its signaling position. As a result of correspondingly coordinating the second degree of freedom of movement with the first degree of freedom of movement, it is accomplished that the movement of the yarn guide from its inactive position to its signaling position turns out to be different from movement in the opposite direction. This recognition is used in the construction of the yarn withdrawal device according to the invention for blocking the return path of the yarn guide after rebounding.

In one embodiment of the yarn withdrawal device according to the invention, the second degree of freedom of movement is realized by a pawl, which is capable of overshooting a shoulder in the direction of the signaling position at a high speed of the yarn guide, whereas the shoulder blocks movement in the opposite direction. This pawl may be integrated both into the stationary part of the sensor and directly into the yarn guide. At a standstill, the blockage must be capable of reversing itself or be manually releasable.

In another preferred embodiment, the yarn guide itself is movable in two degrees of freedom of movement. The yarn guide cooperates with a curved slot, which coordinates the degrees of freedom of movement of the yarn guide. This curved slot is shaped such that while moving from its inactive position to its signaling position, the yarn guide initially advances along a first portion of the curve. Upon arrival at the signaling position, the yarn guide is moved because of its speed and mass moment of inertia along a second portion of the curved slot, which blocks a return to the inactive position.

In a further development of this embodiment, the second part of the curved slot is shaped such that it permits the yarn guide to move along this curved slot several times, and thus decreases its kinetic energy by friction. In the ideal case, the second portion of the curved slot includes a circular guideway, which repeatedly returns the yarn guide to the end position, so that it does not leave the signaling position. Once the yarn guide is inactive, an operator changing the feed yarn packages can easily return it along the first part of the curve to its inactive position.

The yarn withdrawal device is used in a texturing machine for texturing and winding yarns, with the texturing machine unwinding the yarn from the yarn withdrawal device via a feed system.

BRIEF DESCRIPTION OF THE DRAWINGS

In the following, an embodiment is described in greater detail with reference to the attached drawings, in which.

DETAILED DESCRIPTION OF THE PREFERRED EMBODIMENTS

Figure 1:
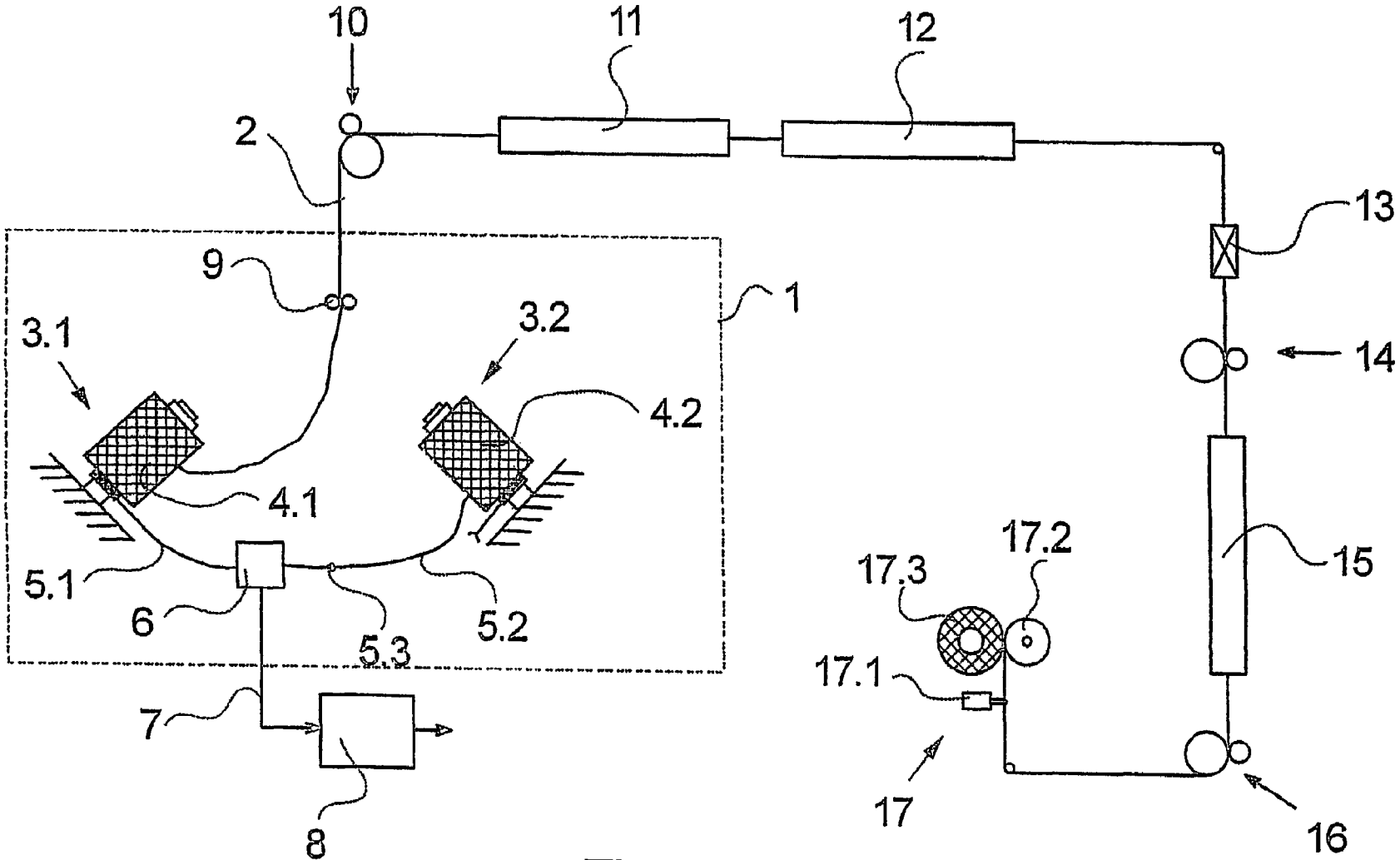
FIG. 1 shows a yarn withdrawal device of the invention as well as a schematic view of the texturing machine.

FIG. 1 schematically illustrates a yarn withdrawal device 1 and a texturing machine 10–17. In the yarn withdrawal device 1, a continuous yarn 2 is made available. To this end, the yarn 2 is unwound via a yarn guide 9 from a feed yarn package 4.1, which is provided in a first creel position 3.1. During the winding of the feed yarn package, a trailing yarn end 5.1 of the feed yarn package 4.1 is guided from the interior of the package out of the stroke range and can therefore be joined by means of a knot 5.3 to the leading yarn end of a reserve yarn package 4.2, which is provided in a second creel position 3.2.

Once the feed yarn package 4.1 is completely unwound, the connection of the trailing yarn end 5.1 to the leading yarn end 5.2 tensions, so that the yarn 2 is pulled out of a sensor 6. This occurrence is detected by the sensor 6 and supplied as a signal 7 to a signal processing unit 8.

After leaving the yarn withdrawal device 1, the yarn 2 is initially advanced in the texturing machine by a first feed system 10, which also builds up the necessary yarn tension for withdrawing the yarn. In the texturing machine, the yarn is sequentially heated in a heater 11, and cooled in a cooling rail 12 such that it sets a twist, which is imparted to the yarn 2 by the texturing unit 13. Subsequently, the yarn is withdrawn by a second feed system 14, heated one more time in a second heater 15, and advanced via a third feed system 16 to a takeup unit 17. The takeup unit 17 comprises a yarn traversing device 17.1, which reciprocates the yarn 2 transversely to the axis of a package 17.3, and a drive roll 17.2, which presses the yarn 2 against the package 17.3, while driving it at the same time.

It is obvious that a knot 5.3 advancing through the process represents an imperfection in the textured yarn. For this reason, it is important to detect with a sensor a knot 5.3 that has passed through the process, and to respond accordingly. This may be done in that a package 17.3 having been produced at this point in time is classified faulty, or also that the package 17.3 is doffed at this point in time, so that the imperfect length of the yarn 2 is not wound.

Figure 2:
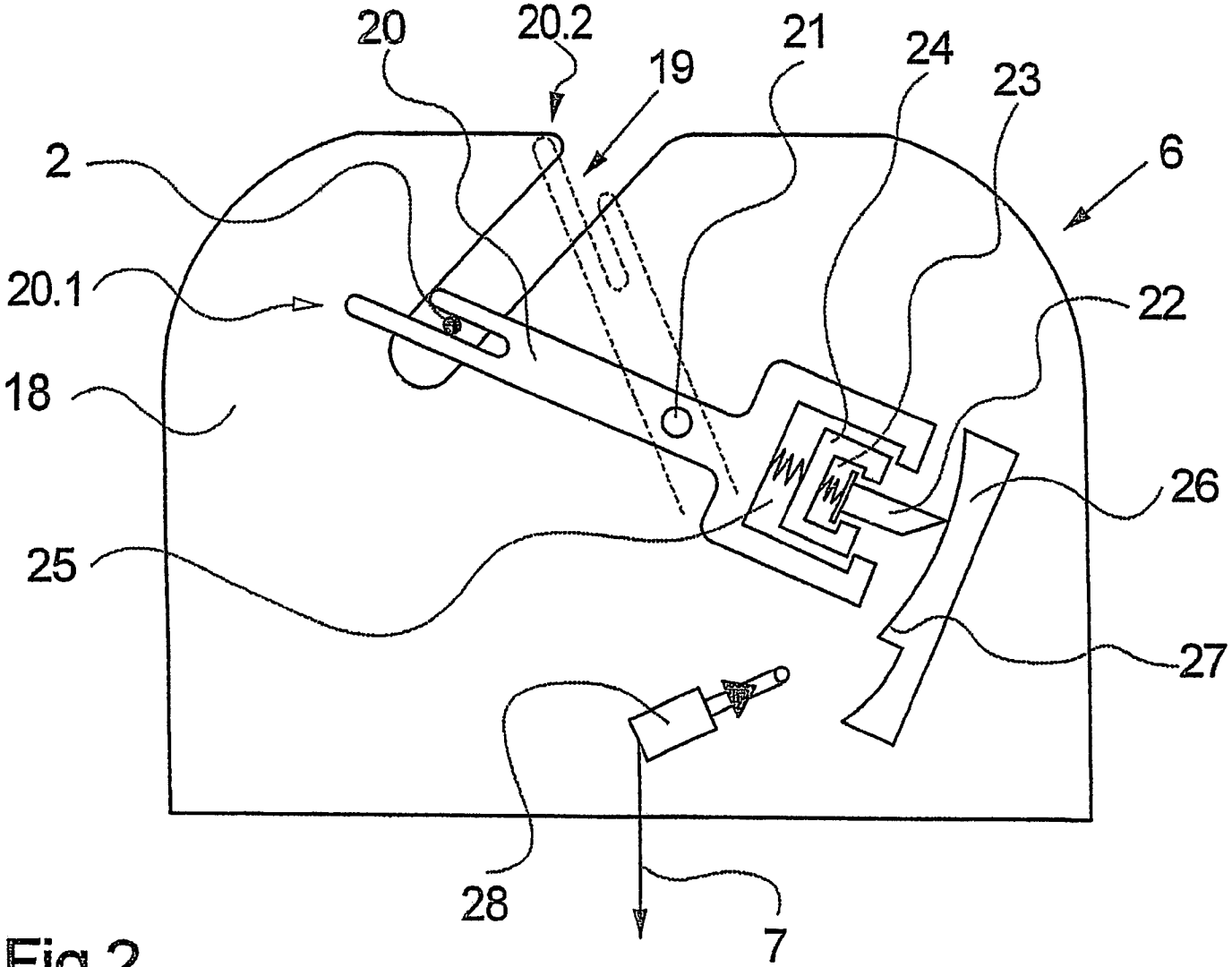
FIG. 2 shows a variant of the sensor of the yarn withdrawal device.

FIG. 2 is a detail view of a first embodiment of the sensor 6. The sensor 6 essentially comprises an insertion slot 19 arranged in a yarn guide support 18, and a yarn guide 20. The yarn guide 20 has a fork shaped end which is aligned with the slot 19, and it is supported for pivotal movement about an axis of rotation 21. In the Figure, the yarn guide 20 is shown in an inactive position 20.1. The yarn 2 is inserted within the fork shaped end of the yarn guide 20 such that a tensioning of the yarn, as it occurs during a transition of the yarn from the feed yarn package 4.1 to the reserve yarn package 4.2 of FIG. 1, pulls the yarn 2 out of the insertion slot 19 and, in so doing, entrains the yarn guide 20 from its inactive position 20.1 to a signaling position 20.2, which is shown in dashed lines. This change in position is detected by a switch 28. Representative of other possible switch principles, such as optical, inductive, or capacitive switches, the Figure shows a mechanical cam switch.

The fact that the tip of the yarn guide 20 is fork-shaped, provides the advantage that during the insertion of the yarn 2 into the slot 19, the yarn guide 20 is moved in one step together with the yarn 2 from its signaling position 20.2 to its inactive position 20.1.

The following describes the movement of the yarn guide 20 during the transition of the yarn 2 from the feed yarn package 4.1 to the reserve yarn package 4.2. Because of the yarn tension, the yarn 2 is laterally pulled out of the insertion slot 19. At high yarn speeds of several hundred meters per minute, very high accelerations act upon the yarn guide 20. The yarn guide 20 pivots at a high speed about the axis of rotation 21 in a direction toward its signaling position 20.2. A pawl 22 that is pushed by means of a spring 23 against a curved body 26 overshoots a shoulder 27. The steep slope on the backside of the shoulder 27 prevents the pawl 22 from overshooting the shoulder in the opposite direction, and thus prevents the yarn guide 20 from rebounding to its inactive position 20.1.

A system comprising a tension spring 25 and a weight 24 that is additionally arranged in the yarn guide 20, and which accommodates the pawl 22 and pawl spring 23, causes the pawl 22 to cooperate with the curve 26 only at high speeds. Because of the friction between the weight 24 and the yarn guide 20, the weight is unable to return to its inactive position during the rebound. Only when the yarn guide 20 has come to a standstill, will the weight 24 and thus the pawl 22 be pulled-back. The operator will then be able to move the yarn guide 20, as has been described above, to its inactive position 20.1. While not described in greater detail, it is likewise possible to integrate the pawl 22 into the stationary yarn guide support 18. Likewise possible is an integration of the described elements, namely pawl 22, pawl spring 23, weight 24, and spring 25 into the yarn guide 20, for example, by flexible solid-body joints.

Figure 3:
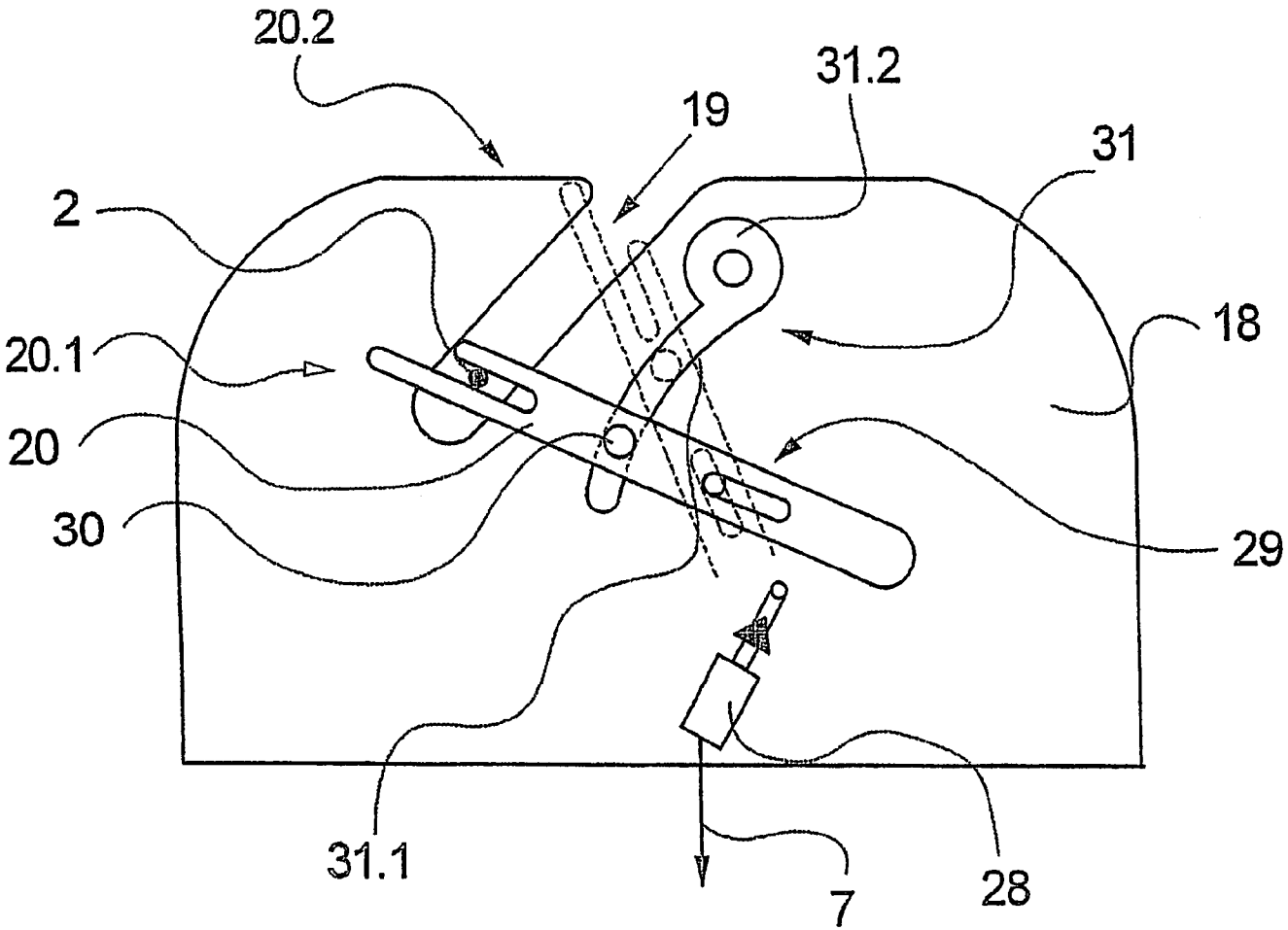
FIG. 3 shows a further variant of the sensor of the yarn withdrawal device.

FIG. 3 is a detail view of another variant of the sensor 6. In this embodiment, the yarn guide 20 connects to the support 18 by means of a turning and sliding joint 29. A cam 30 that is guided in a curved slot 31 coordinates the rotational and the translational degree of freedom. The slot 31 is divided into a first portion 31.1 for the movement of the yarn guide 20 from its inactive position 20.1 to its signaling position 20.2 and a second portion 31.2 for moving the yarn guide 20 after reaching the signaling position 20.2.

Based on the description of FIG. 2, the movement of the yarn guide 20 during a yarn change is described. Starting from its inactive position 20.1, the yarn guide initially performs a movement, which is defined by the advance of the cam 30 in the first portion 31.1 of the slot 31. In FIG. 3, this is a pivotal movement about the pivot of the turning and sliding joint 29. This will apply, until the signaling position 20.2 is reached. In this position, the cam 30 enters the second portion 31.2 of the slot 31. The second portion 31.2 of the slot 31 represents a circular guideway. This circular guideway is configured such that while it allows the yarn guide 20 to rebound in an orderly fashion, it prevents the yarn guide 20 from leaving the area of the signaling position 20.2. Instead, the cam 30 advances along the circular guideway once or several times, and in so doing, it decreases the kinetic energy of the yarn guide. Based on the circular movement of the cam 30, the yarn guide 20 performs a combined pivotal/sliding movement with a small amplitude. As a result of the sliding movement in the turning and sliding joint 29, energy is removed from the yarn guide 20 because of friction.

Because of the smaller space availability, the cam is ideally made truncated. With that, it is possible to achieve a great flexural strength of the cam despite its small structural shape.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for continuously unwinding a yarn, comprising at least two feed positions, with one of the feed positions accommodating a feed yarn package and the other feed position accommodating a reserve package, conveying means for withdrawing the yarn from the feed yarn package and from the reserve package, and with the trailing end of the yarn from the feed yarn package being joined to the leading end of the yarn from the reserve package, and a sensor positioned adjacent the two feed positions for detecting and signaling the transfer of the withdrawn yarn from the feed yarn package to the reserve package, said sensor comprising a yarn guide which is moveable from an inactive position to a signaling position upon the withdrawn yarn transferring from the feed yarn package to the reserve package, and means operable upon movement of the yarn guide from the inactive position to the signaling position for preventing a rebound of the yarn guide from the signaling position back toward the inactive position.

2. The apparatus of claim 1 wherein the sensor further comprises a switch for detecting the movement of the yarn guide from the inactive position to the signaling position.

3. The apparatus of claim 2 wherein the yarn guide is pivotally mounted to a fixed support, and so that the yarn guide is pivotally moveable between the inactive and signaling positions.

4. The apparatus of claim 3 wherein the rebound preventing means defines a first degree of freedom of movement of the yarn guide from the inactive position to the signaling position and a second degree of freedom of movement of the yarn guide from the signaling position to the inactive position, and wherein the first and second degrees of freedom of movement are different from each other and are configured such that they prevent a rebound of the yarn guide from the signaling position back toward the inactive position.

5. The apparatus of claim 4 wherein the second degree of freedom of movement is defined by a pawl which is mounted so as to move with the yarn guide and so as to cooperate with a shoulder which is fixed on the support so that the pawl is capable of overshooting the shoulder during movement of the yarn guide toward the signaling position and so that the shoulder blocks movement of the yarn guide from the signaling position back toward the inactive position.

6. The apparatus of claim 5 wherein the pawl is mounted on the yarn guide.

7. The apparatus of claim 5 wherein the pawl is mounted on the support.

8. The apparatus of claim 4 wherein the first and the second degrees of freedom of movement include a curved slot which coordinates the degrees of freedom of movement in such a manner that during the movement of the yarn guide to the signaling position a first portion of the curved slot is traversed, and that a rebound of the yarn guide results in traversing a second portion of the curved slot, the second portion of the curved slot being shaped such that the yarn guide is prevented from reaching the inactive position.

9. The apparatus of claim 8, wherein the second portion of the curved slot approximately comprises a circular guideway.

10. A texturing machine for texturing and winding a yarn comprising at least two feed positions for mounting a feed yarn package and a reserve package, and wherein a trailing yarn end of the feed yarn package may be joined to a leading yarn end of the reserve package, at least one yarn feed system positioned for withdrawing the yarn from the feed yarn package and then from the reserve package, and advancing the withdrawn yarn along a path of travel leading to a takeup device for forming yarn packages, a texturing device positioned along the yarn path of travel for imparting crimp to the advancing withdrawn yarn, and a sensor positioned adjacent the two feed positions for detecting and signaling the transfer of the withdrawn yarn from the feed yarn package to the reserve package, said sensor comprising a yarn guide which is moveable from an inactive position to a signaling position upon the withdrawn yarn transferring from the feed yarn package to the reserve package, and means operable upon movement of the yarn guide from the inactive position to the signaling position for preventing a rebound of the yarn guide from the signaling position back toward the inactive position.

11. The texturing machine of claim 10 wherein the yarn guide is pivotally mounted to a fixed support, and so that the yarn guide is pivotally moveable between the inactive and signaling positions.

12. The texturing machine of claim 11 wherein one end of the pivotal yarn guide is fork shaped so as to be adapted to receive the yarn therein, and wherein the fixed support includes an insertion slot which extends generally along the path of the fork shaped end of the yarn guide when the yarn guide is pivoted between the inactive and signaling positions.

13. The apparatus of claim 11 wherein the rebound preventing means comprises a pawl carried by one end of the yarn guide, with the pawl cooperating with a curved surface on the fixed support which includes a shoulder for engaging the pawl when the yarn guide pivots from the signaling position back toward the inactive position.

14. The texturing machine of claim 11 wherein the rebound preventing means comprises a curved slot formed in the fixed support, and a cam positioned on the yarn guide so as to be received in the curved slot, with the curved slot having a first portion that is traversed by the cam during movement of the yarn guide from the inactive position to the signaling position, and a second portion that is traversed by the cam during a rebound of the yarn guide, with the second portion being shaped such that the yarn guide is prevented from reaching the inactive position.

15. The texturing machine of claim 14 wherein the second portion of the curved slot is generally circular.

* * * * *